US008328955B2

(12) United States Patent
Wakabayashi et al.

(10) Patent No.: US 8,328,955 B2
(45) Date of Patent: Dec. 11, 2012

(54) PROCESS FOR PRODUCING COMPOSITE MAGNETIC MATERIAL, DUST CORE FORMED FROM SAME, AND PROCESS FOR PRODUCING DUST CORE

(75) Inventors: Yuya Wakabayashi, Hyogo (JP); Takeshi Takahashi, Kyoto (JP); Nobuya Matsutani, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/144,592

(22) PCT Filed: Jan. 14, 2010

(86) PCT No.: PCT/JP2010/000151

§ 371 (c)(1),
(2), (4) Date: Jul. 14, 2011

(87) PCT Pub. No.: WO2010/082486

PCT Pub. Date: Jul. 22, 2010

(65) Prior Publication Data

US 2011/0272622 A1 Nov. 10, 2011

(30) Foreign Application Priority Data

Jan. 16, 2009 (JP) ..... 2009-007404

(51) Int. Cl.
*H01F 1/18* (2006.01)

(52) U.S. Cl. ..... 148/104; 148/300; 148/306

(58) Field of Classification Search ..... None
See application file for complete search history.

(56) References Cited

U.S. PATENT DOCUMENTS

| | | | | |
|---|---|---|---|---|
| 6,063,209 | A | 5/2000 | Matsutani et al. | |
| 6,284,060 | B1 | 9/2001 | Matsutani et al. | |
| 6,312,531 | B1 * | 11/2001 | Matsutani et al. | 148/307 |
| 2002/0097124 | A1 * | 7/2002 | Inoue et al. | 336/83 |
| 2003/0001718 | A1 | 1/2003 | Inoue et al. | |
| 2003/0077448 | A1 | 4/2003 | Ueta et al. | |
| 2004/0052368 | A1 | 3/2004 | Spring et al. | |
| 2004/0207954 | A1 | 10/2004 | Inoue et al. | |
| 2004/0209120 | A1 | 10/2004 | Inoue et al. | |
| 2011/0272622 | A1 * | 11/2011 | Wakabayashi et al. | 252/62.55 |

FOREIGN PATENT DOCUMENTS

| | | | |
|---|---|---|---|
| JP | 63-113808 | A | 5/1988 |
| JP | 11-238613 | A | 8/1999 |
| JP | 11-260618 | A | 9/1999 |
| JP | 2002-305108 | A | 10/2002 |
| JP | 2003-303711 | A | 10/2003 |

OTHER PUBLICATIONS

International Search Report for PCT/JP2010/000151, Apr. 20, 2010.

* cited by examiner

*Primary Examiner* — John Sheehan
(74) *Attorney, Agent, or Firm* — RatnerPrestia

(57) ABSTRACT

A composite magnetic material is manufactured having magnetic properties that can excellently cope with the decreasing size and increasing electric current of magnetic elements, such as choke coils, and can be used in a high frequency range, a dust core using the composite magnetic material, and a method of manufacturing the same. The dust core includes magnetic metal powder and an insulating material, in which the magnetic metal powder has a Vickers hardness (Hv) of 230 ≦ Hv ≦ 1000, the insulating material has a compressive strength of 10000 kg/cm$^2$ or lower and is in a mechanical collapsed state, and the insulating material in a mechanical collapsed state is interposed in the magnetic metal powder.

14 Claims, 2 Drawing Sheets

Figure 1:
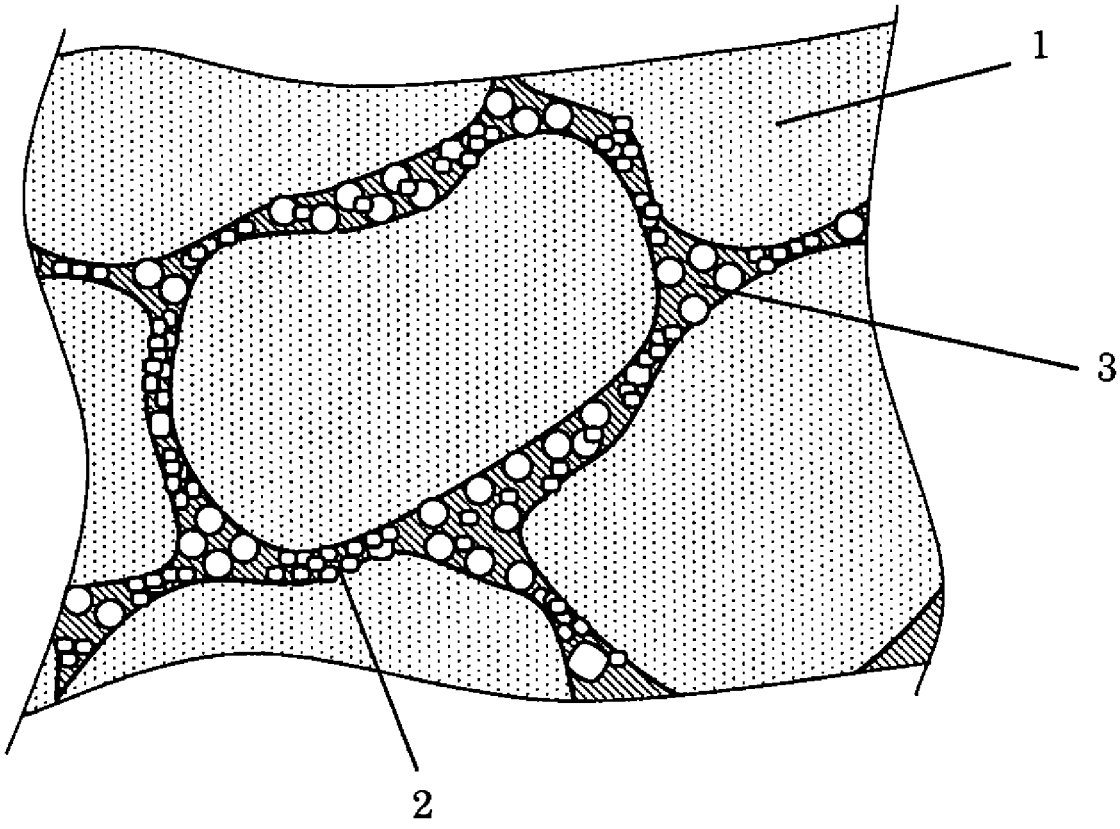

PROCESS FOR PRODUCING COMPOSITE MAGNETIC MATERIAL, DUST CORE FORMED FROM SAME, AND PROCESS FOR PRODUCING DUST CORE

This application is a U.S. National Phase Application of PCT International Application PCT/JP2010/000151.

TECHNICAL FIELD

The invention relates to a composite magnetic material used in vehicle engine control units (ECU) or choke coils in electronic devices for laptops, a method of manufacturing the composite magnetic material, a dust core using the composite magnetic material, and a method of manufacturing the same.

BACKGROUND ART

In accordance with the decreasing size and thickness of electronic devices in recent years, even in choke coils, there has been demand for a magnetic material having magnetic properties that can cope with a decreasing size, an increasing electric current, and an increasing frequency.

As such a type of magnetic material in the related art, a material, in which the surfaces of metal powder including iron as the main component are coated with a film containing a silicone resin and a pigment, is suggested. At the same time, a method of manufacturing the same is suggested.

As a document of the related art regarding the present application, for example, PTL 1 is known.

Citation List

Patent Literature

[PTL 1] JP-A-2003-303711

DISCLOSURE OF THE INVENTION

Problem to be Solved by the Invention

With regard to such a magnetic material in the related art and a dust core using the same, there is a problem in that it is difficult to use these in a high frequency range. That is, in the configuration of the related art, there are problems in that the homogeneity of the pigment is poor in the silicone resin, and, when the silicone resin is decomposed during high-temperature annealing, insulation properties are abruptly degraded. Therefore, it is not possible to anneal a dust core at a high temperature after pressing, and strain that occurs in magnetic metal powder during the pressing cannot be sufficiently relieved. As a result, since it is not possible to reduce hysteresis loss in the dust core, magnetic loss increases. In addition, when the dust core is annealed at a high temperature after the pressing, since thermal decomposition of the silicone resin occurs and metal particles sinter to each other where the pigment is not homogenous, not only eddy-current loss becomes large, but also a decrease in permeability is caused in a high frequency range.

Due to the above reasons, in the magnetic material in the related art, both a high permeability and a low magnetic loss cannot be satisfied at the same time in the high frequency range of a dust core. As a result, the magnetic material in the related art is not suitable as a magnetic material for a dust core used for things that should be small and capable of coping with a large electric current, and have a low loss even in a high frequency range, such as vehicle ECUs or choke coils used in laptops.

Means for Solving the Invention

The invention provides a method of manufacturing a composite magnetic material having magnetic properties that can excellently cope with the decreasing size and increasing electric current of magnetic elements, such as choke coils, and can be used with a low loss even in a high frequency range, a dust core using the composite magnetic material, and a method of manufacturing the same.

The dust core of the invention is a dust core including magnetic metal powder and an insulating material, in which the magnetic metal powder has a Vickers hardness (Hv) of $230 \leqq Hv \leqq 1000$, the insulating material has a compressive strength of 10000 kg/cm$^2$ or lower and is in a mechanical collapsed state, and the insulating material in a mechanical collapsed state is interposed in the magnetic metal powder.

In addition, the method of manufacturing a dust core of the invention includes a step in which a composite magnetic material including a magnetic metal material having a Vickers hardness (Hv) of $230 \leqq Hv \leqq 1000$ and an insulating material having a compressive strength of 10000 kg/cm$^2$ or lower is pressed so as to form a compact, and a step in which a thermal treatment is performed on the compact, and, in the step of forming the compact, the insulating material is made to be in a mechanical collapsed state.

In addition, the method of manufacturing a composite magnetic material of the invention includes a step in which the hardness of magnetic metal powder is increased so that the magnetic metal powder has a Vickers hardness (Hv) of $230 \leqq Hv \leqq 1000$, and a step in which an insulating material having a compressive strength of 10000 kg/cm$^2$ or lower is dispersed in the magnetic metal powder.

ADVANTAGE OF THE INVENTION

Through the above configuration and manufacturing methods, it is possible to improve the insulation properties and heat resistance of the composite magnetic material and to obtain a dust core having favorable permeability and magnetic loss even in a high frequency range.

PREFERRED EMBODIMENTS FOR CARRYING OUT THE INVENTION (Embodiment 1)

The method of manufacturing a composite magnetic material and a dust core using the composite magnetic material, and a method of manufacturing the same in a first embodiment of the invention will be described.

Hereinafter, the composite magnetic material in the first embodiment of the invention will be described. The composite magnetic material in the first embodiment of the invention is a composite magnetic material including magnetic metal powder and an insulating material. The magnetic metal powder has a Vickers hardness (Hv) of $230 \leqq Hv \leqq 1000$. The insulating material has a compressive strength of 10000 kg/cm$^2$ or lower. The composite magnetic material of the embodiment has a configuration in which the insulating material is interposed in the magnetic metal powder.

Since an insulator is present in the magnetic metal powder in the above configuration, it becomes possible to prevent contact between the magnetic metal powder and the magnetic metal powder, and thus it is possible to improve the insulation properties and heat resistance of the composite magnetic material. In addition, it is possible to improve the insulation properties and heat resistance of a dust core using the composite magnetic material and, furthermore, to improve the packing factor. As a result, it is possible to anneal the dust core at a high temperature and to provide a dust core having favorable permeability and magnetic loss even in a high frequency range. Specifically, the magnetic metal power used in Embodiment 1 desirably has a substantially spherical shape. This is because, when magnetic metal powder having a flat shape is used, magnetic anisotropy is given to the dust core, and therefore there is a limitation on available magnetic circuits.

The magnetic metal powder used in Embodiment 1 desirably has a Vickers hardness (Hv) of 230≦Hv≦1000. When the Vickers hardness is smaller than 230 Hv, the mechanical collapse of the insulating material does not occur sufficiently during pressing when a dust core is produced using a composite magnetic material, and thus a high packing factor cannot be obtained. As a result, favorable direct current superposition characteristics and a low magnetic loss cannot be obtained sufficiently. On the other hand, when the Vickers hardness is larger than 1000 Hv, since the plastic deformability of the magnetic metal powder is markedly degraded, a high packing factor cannot be obtained, which is not preferable. The 'mechanical collapse' mentioned here refers to a state in which, when a dust core is pressed, the insulating material is compressed and broken by the magnetic metal powder so as to become fine so that the insulating material is interposed in the magnetic metal powder.

FIG. 1 shows an enlarged view of the dust core according to the embodiment. Insulating material 2 is present in magnetic metal powder 1 in a mechanical collapsed state. In addition, binding agent 3 is present so as to fill voids in this powder.

In addition, the magnetic metal powder used in Embodiment 1 desirably includes at least one of Fe—Ni-based, Fe—Si—Al-based, Fe—Si-based, Fe—Si—Cr-based, and Fe-based magnetic metal powder. Since the magnetic metal powder including Fe as the main component as above has a high saturation magnetic flux density, the magnetic metal powder is useful for use at a high electric current. Hereinafter, conditions for manufacturing a dust core using each of the above magnetic metal powder and the characteristics of the dust core will be described.

When Fe—Ni-based magnetic metal powder is used, the powder desirably includes 40% by weight to 90% by weight of Ni with the balance including Fe and inevitable impurities. Here, examples of the inevitable impurities include Mn, Cr, Ni, P, S, C, or the like. When the content of Ni is smaller than 40% by weight, an effect of improving soft magnetic properties is poor, and, when the content of Ni is larger than 90% by weight, saturated magnetization is significantly degraded, and thus direct current superposition characteristics are degraded. In order to further improve the direct current superposition characteristics, 1% by weight to 6% by weight of Mo may be included.

When Fe—Si—Al-based magnetic metal powder is used, the powder desirably includes 8% by weight to 12% by weight of Si and 4% by weight to 6% by weight of Al with the balance including Fe and inevitable impurities. Here, examples of the inevitable impurities include Mn, Cr, Ni, P, S, C, or the like. By containing the respective elements in the above composition range, high direct current superposition characteristics and a low magnetic coercive force can be obtained.

When Fe—Si-based magnetic metal powder is used, the powder desirably includes 1% by weight to 8% by weight of Si with the balance including Fe and inevitable impurities. Here, examples of the inevitable impurities include Mn, Cr Ni, P, S, C, or the like. By containing Si, there are effects in which magnetic anisotropy and a magnetostriction constant become small, electrical resistance is increased, and eddy-current loss is reduced. When the content of Si is smaller than 1% by weight, an effect of improving soft magnetic properties is poor, and, when the content of Si is larger than 8% by weight, saturated magnetization is significantly degraded, and thus direct current superposition characteristics are degraded.

When Fe—Si—Cr-based magnetic metal powder is used, the powder desirably includes 1% by weight to 8% by weight of Si and 2% by weight to 8% by weight of Cr with the balance including Fe and inevitable impurities. Here, examples of the inevitable impurities include Mn, Cr, Ni, P, S, C, or the like.

By containing Si, there are effects in which magnetic anisotropy and a magnetostriction constant become small, electrical resistance is increased, and eddy-current loss is reduced. When the content of Si is smaller than 1% by weight, an effect of improving soft magnetic properties is poor, and, when the content of Si is larger than 8% by weight, saturated magnetization is significantly degraded, and thus direct current superposition characteristics are degraded. In addition, by containing Cr, there is an effect of improving weather resistance. When the content of Cr is smaller than 2% by weight, an effect of improving weather resistance is poor, and, when the content of Cr is larger than 8% by weight, soft magnetic properties are degraded, which is not preferable.

When Fe-based magnetic metal power is used, the powder is desirably composed of Fe, which is an element of the main component, and inevitable impurities. Here, examples of the inevitable impurities include Mn, Cr, Ni, P, S, C, or the like. By increasing the purity of Fe, it is possible to obtain a high saturation magnetic flux density.

Even when at least two of the Fe—Ni-based, Fe—Si—Al-based, Fe—Si-based, Fe—Si—Cr-based, and Fe-based magnetic metal powders are used, the same effects can be obtained. For example, by combining a magnetic material having a high plastic deformability, such as Fe—Ni-based magnetic metal powder, and a magnetic material having a low plastic deformability, such as Fe—Si—Al-based magnetic metal powder, the packing factor of the magnetic metal powder becomes high, and therefore it is possible to make a composite magnetic material having favorable permeability and magnetic loss.

The insulating material used in Embodiment 1 desirably has a compressive strength of 10000 kg/cm$^2$ or lower. When the compressive strength is larger than 10000 kg/cm$^2$, the mechanical collapse of the insulating material does not occur sufficiently during the pressing of a dust core, and the packing factor of the magnetic metal powder is degraded. As a result, a favorable permeability and a low magnetic loss cannot be obtained.

In addition, the melting point of the insulating material is desirably 1200° C. or higher. With such a configuration, the thermal and chemical stability of the insulating material are improved, and the dissolution of the insulating material and the reaction with the magnetic metal powder can be suppressed even when high-temperature annealing is performed at lower than 1200° C. Therefore, it is possible to provide a composite magnetic material that is advantageous for the improvement of the insulation properties and heat resistance of a dust core.

Examples of the insulating material having a compressive strength of 10000 kg/cm$^2$ or lower and a melting point of 1200° C. or higher include h-BN (hexagonal boron nitride), MgO, mullite ($3Al_2O_3.2SiO_2$), steatite ($MgO.SiO_2$), forsterite ($2MgO.SiO_2$), cordierite ($2MgO.2Al_2O_3.5SiO_2$), and zircon ($ZrO_2.SiO_2$). However, as long as an insulating material has a compressive strength of 10000 kg/cm$^2$ or lower and a melting point of 1200° C. or higher, there is no particular problem in using an insulating material which does not belong to the insulating materials described above.

Hereinafter, the dust core according to Embodiment 1 of the invention will be described. The dust core according to Embodiment 1 of the invention is made of a composite magnetic material including magnetic metal powder and an insulating material in which the magnetic metal powder has a Vickers hardness (Hv) of $230 \leqq Hv \leqq 1000$, and the insulating material has a compressive strength of 10000 kg/cm$^2$ or lower and is in a mechanical collapsed state, and the dust core is made by pressing the composite magnetic powder in which the insulating material in a mechanical collapsed state is interposed in the magnetic metal powder.

With the above configuration, even in the dust core, since the insulating material is interposed in the magnetic metal powder, and thus it is possible to prevent contact between the magnetic metal powder and the magnetic metal powder, it is possible to improve the packing factor, insulation properties, and, furthermore, heat resistance of the dust core. As a result, it is possible to anneal a dust core at a high temperature, and to provide a dust core having a favorable permeability and a low magnetic loss even in a high frequency range.

In the dust core according to Embodiment 1, the packing factor of the magnetic metal powder is desirably 80% or higher when computed by volume. With this configuration, it is possible to obtain a dust core having a more favorable permeability and a lower magnetic loss.

Hereinafter, the method of manufacturing a composite magnetic material and a method of manufacturing a dust core according to Embodiment 1 of the invention will be described.

The method of manufacturing a composite magnetic material according to Embodiment 1 of the invention includes a step in which the hardness of magnetic metal powder having a Vickers hardness (Hv) of $230 \leqq Hv \leqq 1000$ is increased, and a step in which an insulating material having a compressive strength of 10000 kg/cm$^2$ or lower is dispersed in the magnetic metal powder.

By the step in which the hardness of the magnetic metal powder is increased, the mechanical collapse of the insulating material is accelerated during the pressing of the composite magnetic material, and therefore it is possible to make the dust core highly packed.

In addition, by the step in which the insulating material is dispersed in the magnetic metal powder after the improvement of the hardness, it is possible to manufacture the composite magnetic material in which the insulating material is present between the magnetic metal powder and the magnetic metal powder, and thus contact between the magnetic metal powder and the magnetic metal powder is suppressed. Thereby, the insulation properties and heat resistance of the composite magnetic material are improved. By manufacturing a dust core using such a composite magnetic material, it is possible to improve the insulation properties and heat resistance of the dust core.

By manufacturing a dust core using a composite magnetic material that has been manufactured by the above manufacturing method, it is possible to improve the packing factor of a dust core, and to improve the insulation properties and heat resistance of the dust core. As a result, it is possible to anneal a dust core at a high temperature, and to provide a dust core having favorable direct current superposition characteristics and magnetic loss even in a high frequency range.

A specific method for the step of increasing and improving the hardness of the magnetic metal powder in the method of manufacturing a composite magnetic material according to Embodiment 1 will be described. In order to increase the height of the magnetic metal powder, for example, a ball mill is used. Other than a ball mill, as long as a device is a mechanical alloying apparatus which provides a strong compressive shear force to the magnetic metal powder so as to introduce processing strain, for example, a Mechanofusion system manufactured by Hosokawa Micron Group, the device is not limited to the above apparatus.

The step of dispersing the insulating material in the magnetic metal powder after the improvement of the hardness in the method of manufacturing a composite magnetic material according to Embodiment 1 will be described. In order to disperse the insulating material in the magnetic metal powder after the improvement of the hardness, for example, a tumbling ball mill, a planetary ball mill, a V-shaped mixer, or the like is used.

The amount of the insulating material incorporated in the embodiment is desirably 1% by volume to 10% by volume when the volume of the magnetic metal powder is set to 100% by volume. When the amount of the insulating material incorporated is smaller than 1% by volume, the insulation properties in the magnetic metal powder are degraded, and the magnetic loss of a dust core is increased, which is not preferable. In addition, when the amount of the insulating material incorporated is larger than 10% by volume, the fraction of non-magnetic portions in a dust core is increased, and the permeability is degraded, which is not preferable.

In addition, the method of manufacturing a dust core according to Embodiment 1 of the invention includes a step in which a composite magnetic material including a magnetic metal material having a Vickers hardness (Hv) of $230 \leqq Hv \leqq 1000$ and an insulating material having a compressive strength of 10000 kg/cm$^2$ or lower is pressed so as to form a compact, and a step in which a thermal treatment is performed on the compact. In addition, in the step of forming the compact, the insulating material is made to be in a mechanical collapsed state.

Through such a manufacturing method, the packing factor of the dust core is improved, the relief of strain occurring in the magnetic metal powder during the pressing is accelerated, and hysteresis loss is reduced, and therefore it is possible to obtain the dust core having favorable magnetic loss and direct current superposition characteristics.

A method of pressing the composite magnetic material in the method of manufacturing a dust core of the embodiment is not particularly limited, and an ordinary pressing method using a uniaxial presser or the like can be used. The pressing pressure at this time is desirably 5 ton/cm$^2$ to 20 ton/cm$^2$. This is because, when the pressing pressure is lower than 5 ton/cm$^2$, the packing factor of the magnetic metal powder is decreased, and thus the high direct current superposition characteristics cannot be obtained. In addition, when the pressing pressure is higher than 20 ton/cm$^2$, in order to secure the strength of a mold during the pressing, the size of the mold needs to be large, and, furthermore, in order to secure a pressing pressure, the size of a presser also needs to be large. Increasing the size of a mold and a presser raises costs, which is not preferable. Due to the above reasons, the pressing pressure is desirably in a range of 5 ton/cm$^2$ to 20 ton/cm$^2$.

By the thermal treatment step after the pressing of the composite magnetic material in the method of manufacturing a dust core of the embodiment, processing strain introduced to the magnetic metal powder during the pressing is relieved. Processing strain causes the degradation of magnetic properties; however, since the processing strain can be relieved by the thermal treatment step, it is possible to prevent the degradation of magnetic properties.

The thermal treatment temperature is preferably higher, but should be set in a range in which the insulation properties of the magnetic metal powder can be maintained. The thermal treatment temperature in the embodiment is preferably 700° C. to 1150° C. When the temperature is lower than 700° C., the strains are not sufficiently relieved during the pressing, and a sufficient reduction of loss cannot be achieved, which is not preferable. In addition, when the temperature is higher than 1150° C., the magnetic metal powder particles sinter to each other, and eddy-current loss becomes large, which is not preferable.

The atmosphere in the thermal treatment step is desirably a non-oxidizing atmosphere. Examples of the atmosphere are an inert atmosphere, such as Ar gas, $N_2$ gas, or He gas, a reducing atmosphere, such as $H_2$ gas, or a vacuum. In an oxidizing atmosphere, the soft magnetic properties of the magnetic metal powder are degraded due to the oxidation of the magnetic metal powder, or the permeability of the dust core is degraded due to the formation of an oxide film on the surface of the magnetic metal powder, which is not preferable.

In addition, in the step in which the composite magnetic material is pressed so as to form a dust core, it is desirable to appropriately add a binding agent to the composite magnetic material before the pressing in order to secure the strength of the compact.

Here, as the binding agent in Embodiment 1, it is possible to use a silicone resin, an epoxy resin, a phenol resin, a butyl resin, a vinyl chloride resin, a polyamide resin, an acryl resin, or the like. A method of mixing and dispersing the binding agent is not particularly limited.

Hereinafter, a case in which a dust core is manufactured using a composite magnetic powder of a Fe—Ni-based metal will be described specifically using FIG. 2 and Table 1. A magnetic powder of Fe—Ni-based metal having an average particle diameter of 20 μm and including 78% by weight of Ni (hereinafter expressed as 'Fe-78Ni') and, similarly, a magnetic powder of Fe—Ni-based metal including 50% by weight of Ni (hereinafter expressed as 'Fe-50Ni') are prepared. These magnetic metal powders are treated using a planetary ball mill so that the hardness of the magnetic metal powders is increased (hereinafter, this step is referred to as 'a hardness-improving process'). The hardness of the magnetic metal powder is measured using a micro zone tester (manufactured by Mitutoyo Corporation). 5% by volume of each of a variety of insulating materials shown in Table 1 having an average particle diameter of 1 μm is incorporated with respect to 100% by volume of the magnetic metal powder, and the magnetic metal powder and the insulating material are dispersed using a tumbling ball mill, thereby manufacturing a composite magnetic material. The compressive strengths of the insulating materials shown in Table 1 are the results measured using the micro zone tester. One part by mass of a silicone resin is mixed with respect to the composite magnetic material as a binding agent so as to manufacture a compound. The obtained compound is pressed at room temperature with a pressing pressure of 10.5 ton/cm$^2$ so as to manufacture a compact. After that, a thermal treatment is performed on the compact at 1050° C. in a $N_2$ atmosphere for 30 minutes so as to manufacture a dust core. Here, the manufactured dust core has a toroidal shape having approximately an outer diameter of 15 mm, an inner diameter of 10 mm, and a height of 3 mm.

Figure 2:
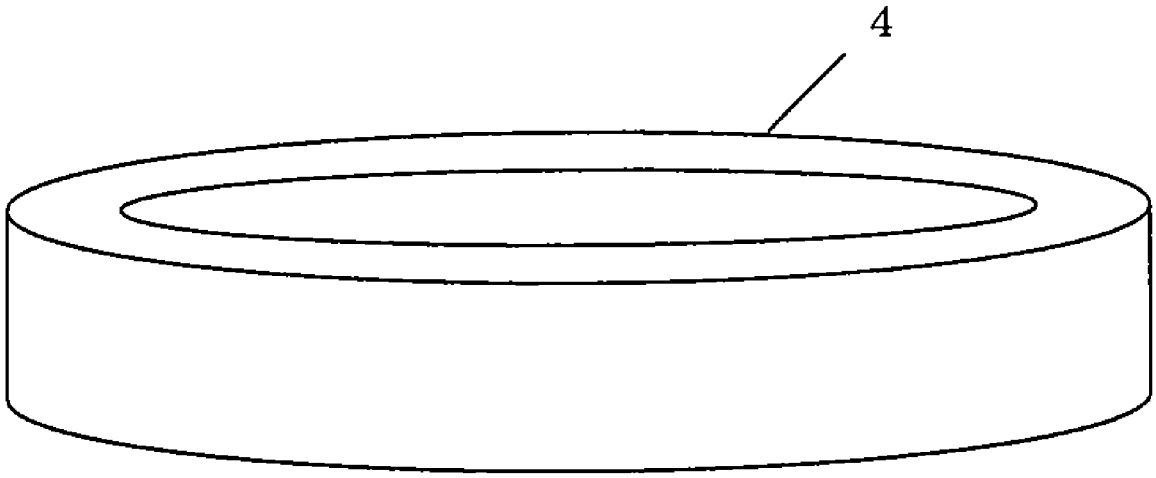

FIG. 2 shows a schematic view of the entire dust core according to the embodiment. Dust core 4 of the embodiment has a toroidal shape as shown in FIG. 2. The dust core according to the embodiment is not limited to such a toroidal shape.

In addition, as Comparative Examples, compounds having no insulating material added are also manufactured, and dust cores are manufactured in the same manner.

Evaluation is performed on the permeability when direct current is superposed and flowed on the obtained dust cores (hereinafter referred to as 'direct current superposition characteristics'), and the magnetic loss, which is also one of the magnetic properties of a dust core.

The direct current superposition characteristics are evaluated in a manner in which an inductance value at an applied magnetic field of 55 Oe, a frequency of 100 kHz, and the number of turns of 20 is measured using an LCR meter (manufactured by HP; 4294A), and the permeability is computed from the obtained inductance value and the shape of the specimen of the dust core. The magnetic loss is measured using a B—H/μ analyzer (manufactured by Iwatsu Test Instruments Corporation: SY-8258) at a measurement frequency of 100 kHz and a measurement magnetic flux density of 0.1 T. Dust cores showing high direct current superposition characteristics and a low magnetic loss belong to Embodiment 1. The obtained evaluation results are shown in Table 1.

TABLE 1

| Sample. No | Magnetic metal powder Composition | Magnetic metal powder Hardness (Hv) | Hardness-improving process | Insulating material Composition | Compressive strength kg/cm$^2$ | Melting point ° C. | Packing factor (%) | Permeability (550e) | Magnetic loss (kW/m$^3$) | |
|---|---|---|---|---|---|---|---|---|---|---|
| 1 | Fe78Ni | 162 | not performed | None | — | — | 88 | 14 | 25500 | Comparative Example |
| 2 | Fe78Ni | 162 | not performed | MgO | 8400 | 2820 | 77.8 | 38 | 7395 | Comparative Example |
| 3 | Fe78Ni | 210 | Performed | h-BN | 540 | 3000 (discomposed) | 79.5 | 44 | 1050 | Comparative Example |
| 4 | Fe78Ni | 210 | Performed | MgO | 8400 | 2820 | 79.1 | 43 | 1105 | Comparative Example |
| 5 | Fe78Ni | 210 | Performed | $Al_2O_3$ | 37000 | 2050 | 71 | 19 | 14600 | Comparative Example |
| 6 | Fe78Ni | 230 | Performed | MgO | 8400 | 2820 | 80.6 | 48 | 650 | Example |
| 7 | Fe78Ni | 350 | Performed | MgO | 8400 | 2820 | 81.6 | 51 | 415 | Example |
| 8 | Fe78Ni | 525 | Performed | MgO | 8400 | 2820 | 83.2 | 62 | 345 | Example |
| 9 | Fe78Ni | 350 | Performed | BeO | 15000 | 2550 | 73.8 | 21 | 8700 | Comparative Example |
| 10 | Fe78Ni | 350 | Performed | $Si_3N_4$ | 35000 | 1840 (discomposed) | 72.1 | 16 | 12560 | Comparative Example |
| 11 | Fe78Ni | 350 | Performed | $Al_2O_3$ | 37000 | 2050 | 70.9 | 19 | 15600 | Comparative Example |
| 12 | Fe78Ni | 350 | Performed | $B_2O_3$ | — | 480 | 75.1 | 32 | 3012 | Comparative Example |
| 13 | Fe78Ni | 350 | Performed | h-BN | 540 | 3000 (discomposed) | 85.4 | 75 | 295 | Example |
| 14 | Fe78Ni | 350 | Performed | Mullite | 7100 | 1850 | 80.9 | 51 | 458 | Example |
| 15 | Fe78Ni | 350 | Performed | Steatite | 5600 | 2050 | 81.4 | 52 | 478 | Example |
| 16 | Fe78Ni | 350 | Performed | Forsterite | 5900 | 1890 | 81.3 | 52 | 481 | Example |
| 17 | Fe78Ni | 350 | Performed | Cordierite | 3500 | 1470 | 81.9 | 53 | 423 | Example |
| 18 | Fe78Ni | 350 | Performed | Zircon | 6300 | 1540 | 81.3 | 50 | 468 | Example |

TABLE 1-continued

| Sample. No | Magnetic metal powder Com-position | Hardness (Hv) | Hardness-improving process | Insulating material Composition | Compressive strength kg/cm$^2$ | Melting point ° C. | Packing factor (%) | Per-meability (550e) | Magnetic loss (kW/m$^3$) | |
|---|---|---|---|---|---|---|---|---|---|---|
| 19 | Fe50Ni | 175 | not performed | None | — | — | 88 | 14 | 27500 | Comparative Example |
| 20 | Fe50Ni | 175 | not performed | MgO | 8400 | 2820 | 76.8 | 37 | 9550 | Comparative Example |
| 21 | Fe50Ni | 215 | Performed | h-BN | 540 | 3000 (discomposed) | 79.6 | 45 | 1450 | Comparative Example |
| 22 | Fe50Ni | 215 | Performed | MgO | 8400 | 2820 | 79.1 | 45 | 1548 | Comparative Example |
| 23 | Fe50Ni | 215 | Performed | $Al_2O_3$ | 37000 | 2050 | 70.8 | 21 | 16300 | Comparative Example |
| 24 | Fe50Ni | 238 | Performed | MgO | 8400 | 2820 | 80.6 | 45 | 975 | Example |
| 25 | Fe50Ni | 355 | Performed | MgO | 8400 | 2820 | 81.6 | 52 | 695 | Example |
| 26 | Fe50Ni | 525 | Performed | MgO | 8400 | 2820 | 83.2 | 64 | 512 | Example |
| 27 | Fe50Ni | 355 | Performed | BeO | 15000 | 2550 | 73.8 | 21 | 10050 | Comparative Example |
| 28 | Fe50Ni | 355 | Performed | $Si_3N_4$ | 35000 | 1840 (discomposed) | 72.1 | 16 | 13500 | Comparative Example |
| 29 | Fe50Ni | 355 | Performed | $Al_2O_3$ | 37000 | 2050 | 70.5 | 18 | 16500 | Comparative Example |
| 30 | Fe50Ni | 355 | Performed | $B_2O_3$ | — | 480 | 75.1 | 32 | 4500 | Comparative Example |
| 31 | Fe50Ni | 355 | Performed | h-BN | 540 | 3000 (discomposed) | 85.4 | 75 | 396 | Example |
| 32 | Fe50Ni | 355 | Performed | Mullite | 7100 | 1850 | 80.9 | 51 | 630 | Example |
| 33 | Fe50Ni | 355 | Performed | Steatite | 5600 | 2050 | 81.4 | 52 | 625 | Example |
| 34 | Fe50Ni | 355 | Performed | Forsterite | 5900 | 1890 | 81.3 | 52 | 642 | Example |
| 35 | Fe50Ni | 355 | Performed | Cordierite | 3500 | 1470 | 81.9 | 53 | 621 | Example |
| 36 | Fe50Ni | 355 | Performed | Zircon | 6300 | 1540 | 81.3 | 50 | 675 | Example |

Samples No. 1 to 18 in Table 1 show the evaluation results of cases in which the Fe-78Ni magnetic metal powder is used. The Vickers hardness Hv of the Fe-78Ni magnetic metal powder is 162 Hv when the powder does not undergo the hardness-improving process.

It is found from Sample No. 1 that, when the hardness-improving process is not performed, and the insulating material is not added, the obtained dust core has a high packing factor, but the magnetic metal powder sinters, the direct current superposition characteristics are low, and the magnetic loss is high.

It is found from Sample No. 2 that, when the hardness-improving is not performed, and the insulating material is added, the packing factor of the obtained dust core is low, and desirable values of direct current superposition characteristics and magnetic loss cannot be obtained. It is considered that the low packing factor results from the fact that, since the hardness-improving process is not performed, the hardness of the magnetic metal powder is low, and thus the mechanical collapse of the insulating material is not sufficient during the pressing of the dust core.

With regard to Samples No. 3 to 18, the Fe-78Ni magnetic metal powder undergoes the hardness-improving process, and thus the hardness increases.

It is found from Samples No. 3 to 5 that, when the Vickers hardness of the magnetic metal powder is 210 Hv or lower, with no regard to the compressive strength of the insulating material, the packing factor of the dust core is lower than 80%, and desirable values of direct current superposition characteristics and magnetic loss cannot be obtained. It is considered that the low packing factor results from the fact that the hardness of the magnetic metal powder is low, and thus the mechanical collapse of the insulating material is not sufficient during the pressing of the dust core.

It is found from Samples No. 6 to 8 that, when the Vickers hardness of the magnetic metal powder is in a range of 230 Hv to 525 Hv, and MgO having a compressive strength of 8400 kg/cm$^2$ is used in the insulating material, the mechanical collapse of the insulating material sufficiently occurs during the pressing of the dust core, and the packing factor of the dust core becomes 80% or higher so that excellent direct current superposition characteristics and a low magnetic loss can be obtained.

It is found from Samples No. 9 to 12 that, when the Vickers hardness of the magnetic metal powder is 350 Hv, and the compressive strength of the insulating material is larger than 10000 kg/cm$^2$, the mechanical collapse of the insulating material does not sufficiently occur during the pressing of the dust core, and the packing factor is decreased such that desirable values of direct current superposition characteristics and magnetic loss cannot be obtained.

It is found from Samples No. 13 to 18 that, when the Vickers hardness of the magnetic metal powder is 350 Hv, and the compressive strength of the insulating material is 10000 kg/cm$^2$ or lower, the mechanical collapse of the insulating material sufficiently occur during the pressing of the dust core, and the packing factor of the dust core becomes 80% or higher so that excellent direct current superposition characteristics and a low magnetic loss can be obtained. In addition, even in the step of dispersing the insulating material, when the compressive strength of the insulating material is 10000 kg/cm$^2$ or lower, it is considered that the insulating material is mechanically collapsed due to the compressive and shear forces applied to the insulating material, and, when the pressing pressure is 6 ton/cm$^2$ or higher, the evenness of the insulating layer on the surface of the magnetic metal powder is improved, which is advantageous for the improvement of the insulation properties and heat resistance.

Furthermore, when the melting point of the insulating material is 1200° C. or higher, the insulating material is excellent in terms of thermal and chemical stability, and thus, when high-temperature annealing is performed, the dissolution of the insulating material and the reaction with the magnetic metal powder can be suppressed, which is advantageous for the improvement of the insulation properties and heat resistance of the dust core.

Samples No. 19 to 36 in Table 1 show the evaluation results of cases in which the Fe-50Ni magnetic metal powder is used. The Vickers hardness Hv of the Fe-50Ni magnetic metal powder is 175 Hv when the powder does not undergo the hardness-improving process.

It is found from Sample No. 19 that, when the hardness-improving process is not performed, and the insulating material is not added, the dust core has a high packing factor, but the magnetic metal powder sinters, the direct current superposition characteristics are low, and the magnetic loss is high.

It is found from Sample No. 20 that, when the hardness-improving is not performed, and the insulating material is added, the packing factor of the dust core is low, and desirable values of direct current superposition characteristics and magnetic loss cannot be obtained. It is considered that the low packing factor results from the fact that the hardness of the magnetic metal powder is low, and thus the mechanical collapse of the insulating material is not sufficient during the pressing of the dust core.

With regard to Samples No. 21 to 36, the Fe-50Ni magnetic metal powder undergoes the hardness-improving process, and thus the hardness increases.

It is found from Samples No. 21 to 23 that, when the Vickers hardness of the magnetic metal powder is 215 Hv or lower, with no regard to the compressive strength of the insulating material, the packing factor of the dust core is lower than 80%, and desirable values of direct current superposition characteristics and magnetic loss cannot be obtained. It is considered that the low packing factor results from the fact that the hardness of the magnetic metal powder is low, and thus the mechanical collapse of the insulating material is not sufficient during the pressing of the dust core.

It is found from Samples No. 24 to 26 that, when the Vickers hardness of the magnetic metal powder is in a range of 238 Hv to 525 Hv, and MgO having a compressive strength of 8400 kg/cm$^2$ is used in the insulating material, the mechanical collapse of the insulating material sufficiently occurs during the pressing of the dust core, and the packing factor of the dust core becomes 80% or higher so that excellent direct current superposition characteristics and a low magnetic loss can be obtained.

It is found from Samples No. 27 to 30 that, when the Vickers hardness of the magnetic metal powder is 355 Hv, and the compressive strength of the insulating material is larger than 10000 kg/cm$^2$, the mechanical collapse of the insulating material does not sufficiently occur during the pressing of the dust core, and the packing factor is decreased such that it is evident that the direct current superposition characteristics and magnetic loss cannot be sufficiently satisfied.

It is found from Samples No. 31 to 36 that, when the Vickers hardness of the magnetic metal powder is 355 Hv, and the compressive strength of the insulating material is 10000 kg/cm$^2$ or lower, the mechanical collapse of the insulating material sufficiently occurs during the pressing of the dust core, and the packing factor of the dust core becomes 80% or higher so that high direct current superposition characteristics and a low magnetic loss can be obtained.

In addition, even in the step of dispersing the insulating material, when the compressive strength of the insulating material is 10000 kg/cm$^2$ or lower, it is considered that the insulating material is mechanically collapsed due to the compressive and shear forces applied to the insulating material, and, when the pressing pressure is 6 ton/cm$^2$ or higher, the evenness of the insulating layer on the surface of the magnetic metal powder is improved, which is advantageous for the improvement of the insulation properties and heat resistance.

Furthermore, when the melting point of the insulating material is 1200° C. or higher, the insulating material is excellent in terms of thermal and chemical stability, and thus, when high-temperature annealing is performed, the dissolution of the insulating material and the reaction with the magnetic metal powder can be suppressed, which is advantageous for the improvement of the insulation properties and heat resistance of the dust core.

It is found from Samples No. 1 to 36 that, when the Vickers hardness of the Fe—Ni-based magnetic metal powder is $230 \leqq Hv \leqq 1000$, and preferably $230 \leqq Hv \leqq 525$, and the compressive strength of the insulating material is 10000 kg/cm$^2$ or lower, the mechanical collapse of the insulating material occurs during the pressing of the dust core, and the packing factor of the dust core is improved so that high direct current superposition characteristics and a low magnetic loss can be obtained.

The insulating material used at this time is desirably a material having a compressive strength of 10000 kg/cm$^2$ or lower and a melting point of 1200° C. or higher, such as h-BN, MgO, mullite ($3Al_2O_3.2SiO_2$), steatite ($MgO.SiO_2$), forsterite ($2MgO.SiO_2$), cordierite ($2MgO.2Al_2O_3.5SiO_2$) and zircon ($ZrO_2.SiO_2$).

Here, as long as an insulating material has a compressive strength of 10000 kg/cm$^2$ or lower and a melting point of 1200° C. or higher, there is no particular problem in using the insulating material which does not belong to the insulating material described above.

Hereinafter, a case in which a dust core is manufactured using a composite magnetic powder of a Fe—Si—Al-based metal will be described.

A magnetic powder of Fe—Si—Al-based metal having an average particle diameter of 10 μm and including Fe-10.2Si-4.5Al is prepared. The magnetic metal powder is treated using a tumbling ball mill so that the hardness of the magnetic metal powder is increased. 7.5% by volume of each of a variety of insulating materials shown in Table 2 having an average particle diameter of 5 μm is incorporated with respect to 100% by volume of the magnetic metal powder, and the magnetic metal powder and the insulating material are dispersed using a planetary ball mill, and the insulating material is dispersed on the surface of the magnetic metal powder, thereby manufacturing a composite magnetic material. 0.9 parts by mass of an epoxy resin is mixed with respect to the composite magnetic material as a binding agent so as to manufacture a compound. The compound is pressed with a pressing pressure of 15 ton/cm$^2$ so as to manufacture a compact, and then a thermal treatment is performed at 700° C. in an Ar atmosphere for 40 minutes so as to manufacture a dust core.

The hardness of the magnetic metal powder, the compressive strength of the insulating material, and the shape, direct current superposition characteristics and magnetic loss of the obtained dust cores are evaluated in the same conditions as described above. The obtained evaluation results are shown in Table 2.

TABLE 2

| | Magnetic metal powder | | Hardness- | Insulating | Compressive | Melting | Packing | Perme- | Magnetic | |
|---|---|---|---|---|---|---|---|---|---|---|
| Sample. No | Composition | Hardness (Hv) | improving process | material Composition | strength kg/cm$^2$ | point ° C. | factor (%) | ability (550e) | loss (kW/m$^3$) | |
| 37 | Fe—10.2Si—4.5A1 | 500 | not performed | h-BN | 540 | 3000 | 81.7 | 51 | 368 | Example |
| 38 | | 650 | Performed | | | (discomposed) | 83.8 | 56 | 335 | Example |

TABLE 2-continued

| Sample. No | Magnetic metal powder Composition | Hardness (Hv) | Hardness-improving process | Insulating material Composition | Compressive strength kg/cm$^2$ | Melting point ° C. | Packing factor (%) | Perme-ability (550e) | Magnetic loss (kW/m$^3$) | |
|---|---|---|---|---|---|---|---|---|---|---|
| 39 | | 800 | Performed | | | | 84.5 | 58 | 283 | Example |
| 40 | | 1000 | Performed | | | | 81.3 | 41 | 305 | Example |
| 41 | | 1100 | Performed | | | | 74.5 | 21 | 756 | Comparative Example |
| 42 | | 500 | not performed | MgO | 8400 | 2820 | 80.9 | 48 | 415 | Example |
| 43 | | 650 | Performed | | | | 82.5 | 54 | 368 | Example |
| 44 | | 800 | Performed | | | | 83.9 | 55 | 330 | Example |
| 45 | | 1000 | Performed | | | | 80.6 | 40 | 360 | Example |
| 46 | | 1100 | Performed | | | | 72.3 | 20 | 950 | Comparative Example |
| 47 | | 500 | not performed | $Al_2O_3$ | 37000 | 2050 | 71 | 17 | 12500 | Comparative Example |
| 48 | | 650 | Performed | | | | 70.5 | 17 | 10500 | Comparative Example |
| 49 | | 800 | Performed | | | | 69.9 | 17 | 9900 | Comparative Example |
| 50 | | 1000 | Performed | | | | 69.7 | 16 | 9500 | Comparative Example |
| 51 | | 1100 | Performed | | | | 68 | 16 | 8980 | Comparative Example |

It is found from Samples No. 37, 42 and 47 that the Vickers hardness Hv of the Fe-10.2Si-4.5Al magnetic metal powder is 500 Hv even when the powder does not undergo the hardness-improving process. Therefore, when the compressive strength of the insulating material is 10000 kg/cm$^2$ or lower, the mechanical collapse of the insulating material sufficiently occurs during the pressing of the dust core, and the packing factor of the dust core becomes 80% or higher. Therefore excellent direct current superposition characteristics and a low magnetic loss are exhibited.

It is found from Samples No. 38 to 40 and 43 to 45 that, when the compressive strength of the insulating material is 10000 kg/cm$^2$ or lower, and the hardness-improving process is performed on the Fe-10.2Si-4.5Al so as to increase the hardness from 500 Hv to 650 Hv to 1000 Hv, the mechanical collapse of the insulating material is further accelerated during the pressing of the dust core, and the packing factor of the dust core becomes 80% or higher. Therefore, excellent direct current superposition characteristics and a low magnetic loss can be obtained. Particularly, a higher packing factor, higher direct current superposition characteristics, and a lower magnetic loss can be obtained by increasing the Vickers hardness to 800 Hv.

On the other hand, it is found from Samples No. 41, 46 and 51 that, when the Vickers hardness of the magnetic metal powder is larger than 1000 Hv, the plastic deformability is significantly degraded, and a high packing factor of the dust core cannot be obtained, and therefore the soft magnetic properties are degraded, which is not preferable.

In addition, as the insulating material to use, h-BN and MgO show high direct current superposition characteristics and a low magnetic loss. However, it is found from Samples No. 47 to 51 that, when $Al_2O_3$ having a compressive strength of 37000 kg/cm$^2$ is used as the insulating material, the packing factor is decreased, and desirable direct current superposition characteristics and magnetic loss are not exhibited.

Thus far, it has been found from Table 2 that, when the Fe—Si—Al-based magnetic metal powder is used, it is desirable that the Vickers hardness of the Fe—Si—Al-based magnetic metal powder be $230 \leqq Hv \leqq 1000$, and preferably $500 \leqq Hv \leqq 1000$, the compressive strength of the insulating material be 10000 kg/cm$^2$ or lower, and the melting point be 1200° C. or higher. In such a case, the mechanical collapse of the insulating material sufficiently occurs during the pressing of the dust core, and the packing factor of the dust core is improved. Therefore, excellent direct current superposition characteristics and a low magnetic loss can be obtained. When the compressive strength of the insulating material is larger than 10000 kg/cm$^2$, the mechanical collapse of the insulating material does not sufficiently occur during the pressing of the dust core, and the packing factor of the dust core is degraded such that the permeability and magnetic loss cannot be sufficiently satisfied.

In addition, even in the step of dispersing the insulating material, when the compressive strength of the insulating material is 10000 kg/cm$^2$ or lower, it is considered that the insulating material is mechanically collapsed due to the compressive and shear forces applied to the insulating material, and, when the pressing pressure is 6 ton/cm$^2$ or higher, the evenness of the insulating layer on the surface of the magnetic metal powder is improved, which is advantageous for the improvement of the insulation properties and heat resistance.

When the melting point of the insulating material is 1200° C. or higher, the insulating material is excellent in terms of thermal and chemical stability, and thus, when high-temperature annealing is performed, the dissolution of the insulating material and the reaction with the magnetic metal powder can be suppressed, which is advantageous for the improvement of the insulation properties and heat resistance of the dust core.

Here, as long as an insulating material has a compressive strength of 10000 kg/cm$^2$ or lower and a melting point of 1200° C. or higher, there is no particular problem in using the insulating material which does not belong to the insulating materials described in the table.

Hereinafter, a case in which a dust core is manufactured using a composite magnetic powder of a Fe—Si-based metal will be described.

Magnetic powders of Fe—Si-based metal having an average particle diameter of 25 μm and including Fe-1Si, Fe-3.5Si, and Fe-6.5Si are prepared. The magnetic metal powders are treated using a planetary ball mill so that the hardness of the magnetic metal powder is increased. 3% by volume of each of a variety of insulating materials shown in Table 3 having an average particle diameter of 2 μm is incorporated with respect to 100% by volume of the magnetic metal powder with the improved hardness, and the insulating material is dispersed on the surface of the magnetic metal powder using a V-shaped mixer, thereby manufacturing a composite magnetic material. 1.1 parts by mass of a phenol resin is mixed with respect to the composite magnetic material as a binding agent so as to manufacture a compound. The obtained compound is pressed with a pressing pressure of 11 ton/cm$^2$ so as to manufacture a compact, and then a thermal treatment is performed at 950° C. in a $N_2$ atmosphere for 1 hour so as to manufacture a dust core.

The hardness of the magnetic metal powder, the compressive strength of the insulating material, and the shape, direct current superposition characteristics and magnetic loss of the obtained dust cores are evaluated in the same conditions as described above. The obtained evaluation results are shown in Table 3.

low, and high direct current superposition characteristics and a low magnetic loss cannot be obtained. It is considered that the low packing factor results from the fact that the hardness of the magnetic metal powder is low, and thus the mechanical collapse of the insulating material is not sufficient during the pressing of the dust core.

It is found from Samples No. 53, 58, and 63 that, when the Vickers hardness of the magnetic metal powder is 215 Hv, with no regard to the compressive strength of the insulating material, the packing factor of the dust core is lower than 80%, and desirable values of direct current superposition characteristics and magnetic loss cannot be obtained. It is considered that the low packing factor results from the fact that the hardness of the magnetic metal powder is low, and thus the mechanical collapse of the insulating material is not sufficient during the pressing of the dust core.

TABLE 3

| Sample No | Magnetic metal powder Composition | Magnetic metal powder Hardness (Hv) | Hardness-improving process | Insulating material Composition | Compressive strength kg/cm$^2$ | Melting point ° C. | Packing factor (%) | Permeability (550e) | Magnetic loss (kW/m$^3$) | |
|---|---|---|---|---|---|---|---|---|---|---|
| 52 | Fe—1Si | 135 | not performed | h-BN | 540 | 3000 | 77 | 42 | 4400 | Comparative Example |
| 53 | | 215 | Performed | | | (discomposed) | 79.7 | 44 | 3000 | Comparative Example |
| 54 | | 235 | Performed | | | | 81.1 | 47 | 2400 | Example |
| 55 | | 365 | Performed | | | | 82 | 50 | 2250 | Example |
| 56 | | 510 | Performed | | | | 82.5 | 52 | 2100 | Example |
| 57 | | 135 | not performed | MgO | 8400 | 2820 | 76.8 | 42 | 4500 | Comparative Example |
| 58 | | 215 | Performed | | | | 79.2 | 43 | 3100 | Comparative Example |
| 59 | | 235 | Performed | | | | 80.2 | 46 | 2600 | Example |
| 60 | | 365 | Performed | | | | 81.7 | 49 | 2400 | Example |
| 61 | | 510 | Performed | | | | 82.2 | 51 | 2200 | Example |
| 62 | | 135 | not performed | $Al_2O_3$ | 37000 | 2050 | 70.8 | 18 | 16200 | Comparative Example |
| 63 | | 215 | Performed | | | | 70.6 | 18 | 17000 | Comparative Example |
| 64 | | 235 | Performed | | | | 70.1 | 18 | 17200 | Comparative Example |
| 65 | | 365 | Performed | | | | 69.5 | 18 | 17300 | Comparative Example |
| 66 | | 510 | Performed | | | | 68.9 | 17 | 17950 | Comparative Example |
| 67 | Fe—3.5Si | 195 | not performed | h-BN | 540 | 3000 | 79.4 | 44 | 1450 | Comparative Example |
| 68 | | 232 | Performed | | | (discomposed) | 81.2 | 48 | 1280 | Example |
| 69 | | 400 | Performed | | | | 82.6 | 54 | 950 | Example |
| 70 | | 580 | Performed | | | | 83.9 | 56 | 820 | Example |
| 71 | | 195 | not performed | MgO | 8400 | 2820 | 79.2 | 44 | 1500 | Comparative Example |
| 72 | | 232 | Performed | | | | 80.9 | 47 | 1350 | Example |
| 73 | | 400 | Performed | | | | 82.2 | 52 | 1050 | Example |
| 74 | | 580 | Performed | | | | 83.7 | 53 | 900 | Example |
| 75 | | 195 | not performed | $Al_2O_3$ | 37000 | 2050 | 70.2 | 18 | 15400 | Comparative Example |
| 76 | | 232 | Performed | | | | 69.5 | 18 | 16200 | Comparative Example |
| 77 | | 400 | Performed | | | | 68.9 | 17 | 16900 | Comparative Example |
| 78 | | 580 | Performed | | | | 68.1 | 17 | 17500 | Comparative Example |
| 79 | Fe—6.5Si | 420 | not performed | h-BN | 540 | 3000 | 80.9 | 48 | 1250 | Example |
| 80 | | 600 | Performed | | | (discomposed) | 82 | 52 | 1050 | Example |
| 81 | | 750 | Performed | | | | 83.4 | 53 | 820 | Example |
| 82 | | 1000 | Performed | | | | 82.5 | 51 | 990 | Example |
| 83 | | 1150 | Performed | | | | 79.3 | 37 | 1500 | Comparative Example |
| 84 | | 420 | not performed | MgO | 8400 | 2820 | 80.6 | 47 | 1300 | Example |
| 85 | | 600 | Performed | | | | 81.7 | 51 | 1100 | Example |
| 86 | | 750 | Performed | | | | 83.1 | 52 | 870 | Example |
| 87 | | 1000 | Performed | | | | 80.4 | 49 | 1030 | Example |
| 88 | | 1150 | Performed | | | | 79.1 | 36 | 1650 | Comparative Example |
| 89 | | 420 | not performed | $Al_2O_3$ | 37000 | 2050 | 68.5 | 17 | 13500 | Comparative Example |
| 90 | | 600 | Performed | | | | 67.9 | 17 | 13800 | Comparative Example |
| 91 | | 750 | Performed | | | | 67.5 | 17 | 13800 | Comparative Example |
| 92 | | 1000 | Performed | | | | 66.2 | 16 | 14000 | Comparative Example |
| 93 | | 1150 | Performed | | | | 62.5 | 14 | 15500 | Comparative Example |

The evaluation results of cases in which the Fe-1Si magnetic metal powder is used for Samples No. 52 to 66 are shown.

The Vickers hardness of the Fe-1Si is 135 Hv when the powder does not undergo the hardness-improving process.

It is found from Samples No. 52, 57, and 62 that, when the hardness-improving process is not performed, and the insulating material is added, the packing factor of the dust core is It is found from Samples No. 54 to 56 and 59 to 61 that, when the compressive strength of the insulating material is 10000 kg/cm$^2$ or lower, and the hardness-improving process is performed on the Fe-1Si so as to obtain a hardness of 235 Hv to 510 Hv, the mechanical collapse of the insulating material occurs during the pressing of the dust core, and the packing factor of the dust core becomes 80% or higher so that excellent direct current superposition characteristics and a low magnetic loss can be obtained.

It is found from Samples No. 64 to 66 that, in a case in which $Al_2O_3$ having a compressive strength of 37000 kg/cm$^2$ is used as the insulating material even when the hardness-improving process is performed on the Fe-1Si, the packing factor of the dust core is decreased, and excellent direct current superposition characteristics and a low magnetic loss cannot be obtained.

The evaluation results of cases in which the Fe-3.5Si magnetic metal powder is used are shown at Samples No. 67 to 78 in Table 3.

The Vickers hardness of the Fe-3.5Si is 195 Hv when the powder does not undergo the hardness-improving process.

It is found from Samples No. 67, 71, and 75 that, when the hardness-improving process is not performed, and the insulating material is added, the packing factor of the dust core is low, and desirable values of direct current superposition characteristics and magnetic loss cannot be obtained. It is considered that the low packing factor results from the fact that the hardness of the magnetic metal powder is low, and thus the mechanical collapse of the insulating material is not sufficient during the pressing of the dust core.

It is found from Samples No. 68 to 70 and 72 to 74 that, when the compressive strength of the insulating material is 10000 kg/cm$^2$ or lower, and the hardness of the Fe-3.5Si magnetic metal powder is 232 Hv to 580 Hv, the mechanical collapse of the insulating material sufficiently occurs during the pressing of the dust core, and the packing factor of the dust core becomes 80% or higher so that excellent direct current superposition characteristics and a low magnetic loss can be obtained.

It is found from Samples No. 76 to 78 that, in a case in which $Al_2O_3$ having a compressive strength of 37000 kg/cm$^2$ is used as the insulating material even when the hardness-improving process is performed on the Fe-3.5Si, the packing factor of the dust core is decreased, and excellent direct current superposition characteristics and a low magnetic loss cannot be obtained.

The evaluation results of cases in which the Fe-6.5Si magnetic metal powder is used for Samples No. 79 to 93 are shown.

The Vickers hardness of the Fe-6.5Si is 420 Hv even when the powder does not undergo the hardness-improving process, and it is found from Samples No. 79 and 84 that, when the compressive strength of the insulating material is 10000 kg/cm$^2$ or lower, the mechanical collapse of the insulating material sufficiently occurs during the pressing of the dust core, and the packing factor of the dust core becomes 80% or higher so that excellent direct current superposition characteristics and a low magnetic loss are exhibited even when the powder is used as it is.

It is found from Samples No. 80 to 82 and 85 to 87 that, when the compressive strength of the insulating material is 10000 kg/cm$^2$ or lower, and the hardness-improving process is performed on the Fe-6.5Si so as to increase the hardness to 600 Hv to 1000 Hv, the mechanical collapse of the insulating material is further accelerated during the pressing of the dust core, and the packing factor of the dust core becomes 80% or higher so that excellent direct current superposition characteristics and a low magnetic loss are exhibited. It is found from Samples No. 81 and 86 that, particularly when the Vickers hardness of the Fe-6.5Si magnetic metal powder is increased to 750 Hv, a high packing factor, a high permeability, and a low magnetic loss are exhibited.

It is found from Samples No. 83, 88, and 93 that, when the Vickers hardness of the Fe-6.5Si magnetic metal powder is larger than 1000 Hv, plastic deformability is significantly degraded and thus a high packing factor cannot be obtained such that soft magnetic properties are degraded, which is not preferable.

It is found from Samples No. 90 to 93 that, in a case in which $Al_2O_3$ having a compressive strength of 37000 kg/cm$^2$ is used as the insulating material even when the hardness-improving process is performed on the Fe-6.5Si, the packing factor is decreased, and excellent direct current superposition characteristics and a low magnetic loss are not exhibited.

Thus far, it has been found from Table 3 that, in the case of a composite magnetic material using the Fe—Si-based magnetic metal powder, it is desirable that the Vickers hardness of the Fe—Si-based magnetic metal powder be $230 \leqq Hv \leqq 1000$, the compressive strength of the insulating material, such as h-BN and MgO, be 10000 kg/cm$^2$ or lower, and the melting point be 1200° C. or higher. In a case in which the compressive strength of the insulating material is 10000 kg/cm$^2$ or lower, the mechanical collapse of the insulating material sufficiently occurs during the pressing of the dust core, and the packing factor of the dust core is improved so that excellent direct current superposition characteristics and a low magnetic loss are exhibited. When the compressive strength of the insulating material is larger than 10000 kg/cm$^2$, the mechanical collapse of the insulating material does not sufficiently occur during the pressing of the dust core, and the packing factor of the dust core is degraded such that desirable values of direct current superposition characteristics and magnetic loss cannot be obtained.

In addition, even in the step of dispersing the insulating material, when the compressive strength of the insulating material is 10000 kg/cm$^2$ or lower, it is considered that the insulating material is mechanically collapsed due to the compressive and shear forces applied to the insulating material, and, when the pressing pressure is 6 ton/cm$^2$ or higher, the evenness of the insulating layer on the surface of the magnetic metal powder is improved, which is advantageous for the improvement of the insulation properties and heat resistance.

When the melting point of the insulating material is 1200° C. or higher, the insulating material is excellent in terms of thermal and chemical stability, and thus, when a high-temperature treatment is performed, the dissolution of the insulating material and the reaction with the magnetic metal powder can be suppressed, which is advantageous for the improvement of the insulation properties and heat resistance of the dust core.

Here, as long as an insulating material has a compressive strength of 10000 kg/cm$^2$ or lower and a melting point of 1200° C. or higher, there is no particular problem in using the insulating material which does not belong to the insulating materials described in the table.

Hereinafter, a case in which a dust core is manufactured using a composite magnetic powder of a Fe—Si—Cr-based metal will be described.

Magnetic powder of Fe—Si—Cr-based metal having an average particle diameter of 30 μm and having an alloy composition of, by % by weight, Fe-5Si-5Cr is prepared. The magnetic metal powder is treated using a planetary ball mill so that the hardness of the magnetic metal powder is increased. 7% by volume of each of a variety of insulating materials shown in Table 4 having an average particle diameter of 4 μm is incorporated with respect to 100% by volume of the magnetic metal powder with the improved hardness, the magnetic metal powder and the insulating material are dispersed using a planetary ball mill, and the insulating material is dispersed on the surface of the magnetic metal powder, thereby manufacturing a composite magnetic material. 1.4 parts by mass of a silicone resin is mixed with respect to the composite magnetic material as a binding agent so as to manufacture a compound. The obtained compound is pressed with a pressing pressure of 14 ton/cm$^2$ so as to manufacture a compact, and then a thermal treatment is performed at 900° C. in an Ar atmosphere for 45 minutes so as to manufacture a dust core.

The hardness of the magnetic metal powder, the compressive strength of the insulating material, and the shape, direct current superposition characteristics and magnetic loss of the obtained dust cores are evaluated in the same conditions as described above. The obtained evaluation results are shown in Table 4.

magnetic metal powder is larger than 1000 Hv, the plastic deformability is significantly degraded, and thus a high packing factor cannot be obtained. Therefore the soft magnetic properties are degraded, which is not preferable.

In addition, as the insulating material to use at this time, h-BN and MgO show favorable direct current superposition characteristics and a low magnetic loss. However, it is found from Samples No. 104 to 108 that, when $Al_2O_3$ having a compressive strength of 37000 kg/cm$^2$ is used as the insulating material, the packing factor is decreased, and excellent direct current superposition characteristics and a low magnetic loss are not exhibited.

TABLE 4

| | Magnetic metal powder | | Hardness- | Insulating | Compressive | | Packing | | Magnetic | |
|---|---|---|---|---|---|---|---|---|---|---|
| Sample. No | Composition | Hardness (Hv) | improving process | material Composition | strength kg/cm$^2$ | Melting point ° C. | factor (%) | Permeability (550e) | loss (kW/m$^3$) | |
| 94 | Fe—5Si—5Cr | 450 | not performed | h-BN | 540 | 3000 (discomposed) | 82.1 | 52 | 2300 | Example |
| 95 | | 640 | Performed | | | | 83.9 | 57 | 2110 | Example |
| 96 | | 780 | Performed | | | | 84.8 | 59 | 1930 | Example |
| 97 | | 1000 | Performed | | | | 81.2 | 42 | 2130 | Example |
| 98 | | 1050 | Performed | | | | 74.9 | 21 | 3050 | Comparative Example |
| 99 | | 450 | not performed | MgO | 8400 | 2820 | 80.9 | 50 | 2210 | Example |
| 100 | | 640 | Performed | | | | 82.5 | 54 | 2030 | Example |
| 101 | | 780 | Performed | | | | 83.9 | 56 | 1840 | Example |
| 102 | | 1000 | Performed | | | | 80.6 | 40 | 1990 | Example |
| 103 | | 1050 | Performed | | | | 72.3 | 19 | 2890 | Comparative Example |
| 104 | | 450 | not performed | $Al_2O_3$ | 37000 | 2050 | 70 | 17 | 14500 | Comparative Example |
| 105 | | 640 | Performed | | | | 70.5 | 17 | 13200 | Comparative Example |
| 106 | | 780 | Performed | | | | 70.1 | 17 | 13000 | Comparative Example |
| 107 | | 1000 | Performed | | | | 69.7 | 16 | 13600 | Comparative Example |
| 108 | | 1050 | Performed | | | | 67.8 | 16 | 15800 | Comparative Example |

It is found from Samples No. 94, 99, and 104 that the Vickers hardness of the Fe-5Si-5Cr magnetic metal powder is 450 Hv even when the hardness is not increased by the hardness-improving process, and the mechanical collapse of the insulating material sufficiently occurs during the pressing of the dust core under a condition in which the compressive strength of the insulating material is 10000 kg/cm$^2$ or lower. Therefore, the packing factor of the dust core becomes 80% or higher, and thus excellent direct current superposition characteristics and a low magnetic loss are exhibited even when the powder is used as it is.

It is found from Samples No. 95 to 97 and 100 to 102 that, when the compressive strength of the insulating material is 10000 kg/cm$^2$ or lower, and the hardness-improving process is performed on the Fe-5Si-5Cr magnetic metal powder so as to increase the hardness from 450 Hv to 640 Hv to 1000 Hv, the mechanical collapse of the insulating material is further accelerated during the pressing of the dust core, and the packing factor of the dust core becomes 80% or higher so that excellent direct current superposition characteristics and a low magnetic loss can be obtained. Particularly, a higher packing factor, higher direct current superposition characteristics, and a lower magnetic loss are exhibited by increasing the Vickers hardness of the Fe-5Si-5Cr magnetic metal powder to 780 Hv.

On the other hand, it is found from Samples No. 98, 103 and 108 that, when the Vickers hardness of the Fe-5Si-5Cr Thus far, it has been found from Table 4 that, in the case of a composite magnetic material using the Fe—Si—Cr-based magnetic metal powder, it is desirable that the Vickers hardness of the Fe—Si—Cr-based magnetic metal powder be 450 Hv to 1000 Hv, the compressive strength of the insulating material, such as h-BN or MgO, be 10000 kg/cm$^2$ or lower, and the melting point be 1200° C. or higher. In such a case, the mechanical collapse of the insulating material sufficiently occurs during the pressing of the dust core, and the packing factor of the dust core is improved so that excellent direct current superposition characteristics and a low magnetic loss can be obtained. When the compressive strength of the insulating material is larger than 10000 kg/cm$^2$, the mechanical collapse of the insulating material does not sufficiently occur during the pressing of the dust core, and the packing factor of the dust core is degraded such that desirable values of direct current superposition characteristics and magnetic loss cannot be obtained. In addition, even in the step of dispersing the insulating material, when the compressive strength of the insulating material is 10000 kg/cm$^2$ or lower, it is considered that the insulating material is mechanically collapsed due to the compressive and shear forces applied to the insulating material, and, when the pressing pressure is 6 ton/cm$^2$ or higher, the evenness of the insulating layer on the surface of the magnetic metal powder is improved, which is advantageous for the improvement of the insulation properties and heat resistance.

When the melting point of the insulating material is 1200° C. or higher, the insulating material is excellent in terms of thermal and chemical stability, and thus, when a high-temperature treatment is performed, the dissolution of the insulating material and the reaction with the magnetic metal powder can be suppressed, which is advantageous for the improvement of the insulation properties and heat resistance of the dust core.

Here, as long as an insulating material has a compressive strength of 10000 kg/cm$^2$ or lower and a melting point of 1200° C. or higher, there is no particular problem in using the insulating material which does not belong to the insulating materials described in the table.

Hereinafter, a case in which a dust core is manufactured using a composite magnetic powder of a Fe-based metal will be described. Fe-based magnetic metal powder having an average particle diameter of 8 μm is prepared, and the magnetic metal powder is treated using a tumbling ball mill so that the hardness of the magnetic metal powder is increased. 8% by volume of each of a variety of insulating materials shown in Table 5 having an average particle diameter of 10 μm is incorporated with respect to 100% by volume of the magnetic metal powder with the increased hardness, and the magnetic metal powder and the insulating material are dispersed using a Mechanofusion system, thereby manufacturing a composite magnetic powder. 0.8 parts by mass of an epoxy resin is mixed with respect to the composite magnetic powder as a binding agent so as to manufacture a compound. The compound obtained in the above manner is pressed at room temperature with a pressing pressure of 10 ton/cm$^2$ so as to manufacture a compact, and then a thermal treatment is performed at 750° C. in a $N_2$ atmosphere for 30 minutes so as to manufacture a dust core.

The hardness of the magnetic metal powder, the compressive strength of the insulating material, and the shape, direct current superposition characteristics and magnetic loss of the obtained dust cores are evaluated in the same conditions as described above. The obtained evaluation results are shown in Table 5.

insulating material is added, the packing factor of the dust core is low, and direct current superposition characteristics and a magnetic loss are not sufficient. It is considered that the low packing factor results from the fact that the hardness of the magnetic metal powder is low, and thus the mechanical collapse of the insulating material is not sufficient during the pressing of the dust core.

It is found from Samples No. 110 to 112 and 114 to 116 that, when the compressive strength of the insulating material is 10000 kg/cm$^2$ or lower, and the hardness-improving process is performed on the Fe-based magnetic metal powder so as to increase the hardness from 125 Hv to 235 Hv to 490 Hv, the mechanical collapse of the insulating material occurs during the pressing of the dust core, and the packing factor of the dust core becomes 80% or higher so that excellent direct current superposition characteristics and a low magnetic loss are exhibited.

It is found from Samples No. 118 to 120 that, in a case in which $Al_2O_3$ having a compressive strength of 37000 kg/cm$^2$ is used as the insulating material even when the hardness-improving process is performed on the Fe-based magnetic metal powder, the packing factor of the dust core is decreased, and excellent direct current superposition characteristics and a low magnetic loss are not exhibited.

Thus far, it has been found from Table 5 that, in the case of a composite magnetic material using the Fe-based magnetic metal powder, it is desirable that the Vickers hardness of the magnetic metal powder be 230≦Hv≦1000, and preferably 235≦Hv≦490, the compressive strength of the insulating material, such as h-BN and MgO, be 10000 kg/cm$^2$ or lower, and the melting point be 1200° C. or higher. When the compressive strength of the insulating material is 10000 kg/cm$^2$ or lower, the mechanical collapse of the insulating material occurs during the pressing of the dust core, and the packing factor of the dust core is improved so that excellent direct current superposition characteristics and a low magnetic loss are exhibited. When the compressive strength of the insulating material is larger than 10000 kg/cm$^2$, the mechanical collapse of the insulating material does not sufficiently occur

TABLE 5

| | Magnetic metal powder | | Hardness- | Insulating | Compressive | | Packing | | Magnetic | |
|---|---|---|---|---|---|---|---|---|---|---|
| Sample. No | Composition | Hardness (Hv) | improving process | material Composition | strength kg/cm$^2$ | Melting point ° C. | factor (%) | Permeability (550e) | loss (kW/m$^3$) | |
| 109 | Fe | 125 | not performed | h-BN | 540 | 3000 (discomposed) | 77.5 | 39 | 4500 | Comparative Example |
| 110 | | 235 | Performed | | | | 81.1 | 47 | 2600 | Example |
| 111 | | 340 | Performed | | | | 82.1 | 50 | 2500 | Example |
| 112 | | 490 | Performed | | | | 82.4 | 52 | 2350 | Example |
| 113 | | 125 | not performed | MgO | 8400 | 2820 | 77.8 | 39 | 4350 | Comparative Example |
| 114 | | 235 | Performed | | | | 81.3 | 48 | 2550 | Example |
| 115 | | 340 | Performed | | | | 82.5 | 50 | 2460 | Example |
| 116 | | 490 | Performed | | | | 82.9 | 53 | 2320 | Example |
| 117 | | 125 | not performed | $Al_2O_3$ | 37000 | 2050 | 70.1 | 17 | 18600 | Comparative Example |
| 118 | | 235 | Performed | | | | 70.4 | 17 | 18750 | Comparative Example |
| 119 | | 340 | Performed | | | | 70.5 | 17 | 18800 | Comparative Example |
| 120 | | 490 | Performed | | | | 70.6 | 18 | 19050 | Comparative Example |

The Vickers hardness of the Fe-based magnetic metal powder is 125 Hv when the powder does not undergo the hardness-improving process.

It is found from Samples No. 109, 113, and 117 that, when the hardness-improving process is not performed, and the during the pressing of the dust core, and the packing factor of the dust core is degraded such that desirable values of direct current superposition characteristics and magnetic loss cannot be obtained. In addition, even in the step of dispersing the insulating material, when the compressive strength of the insulating material is 10000 kg/cm$^2$ or lower, it is considered that the insulating material is mechanically collapsed due to the compressive and shear forces applied to the insulating material, and, when the pressing pressure is 6 ton/cm$^2$ or higher, the evenness of the insulating layer on the surface of the magnetic metal powder is improved, which is advantageous for the improvement of the insulation properties and heat resistance.

When the melting point of the insulating material is 1200° C. or higher, the insulating material is excellent in terms of thermal and chemical stability, and thus, when a high-temperature treatment is performed, the dissolution of the insulating material and the reaction with the magnetic metal powder can be suppressed, which is advantageous for the improvement of the insulation properties and heat resistance of the dust core.

Here, as long as an insulating material has a compressive strength of 10000 kg/cm$^2$ or lower and a melting point of 1200° C. or higher, there is no particular problem in using an insulating material which does not belong to the insulating materials described in the table.

From Tables 1, 2, 3, 4, and 5, the following can be mentioned with regard to the magnetic metal powder and the insulating material.

The Vickers hardness (Hv) of the magnetic metal powder is desirably 230 Hv to 1000 Hv, and the same effect can be obtained even when the powder undergoes the hardness-improving process so that the hardness is increased and reaches a predetermined value. When the Vickers hardness of the magnetic metal powder is smaller than 230 Hv, the mechanical collapse of the insulting material does not sufficiently occur, and excellent direct current superposition characteristics and a low magnetic loss are not exhibited. On the other hand, when the Vickers hardness of the magnetic metal powder is larger than 1000 Hv, since the plastic deformability of the magnetic metal powder is markedly degraded, a high packing factor cannot be obtained, and therefore soft magnetic properties are degraded, which is not preferable.

In addition, the packing factor of the magnetic metal powder in the dust core is desirably 80% or higher when computed by volume. With a packing factor of 80% or higher, excellent direct current superposition characteristics and a low magnetic loss are exhibited.

The compressive strength of the insulating material is desirably 10000 kg/cm$^2$ or lower. When the compressive strength is larger than 10000 kg/cm$^2$, since the mechanical collapse of the insulating material does not sufficiently occur during the pressing, the packing factor of the magnetic metal powder is degraded and thus excellent direct current superposition characteristics and a low magnetic loss are not exhibited.

The insulating material having a compressive strength of 10000 kg/cm$^2$ or lower desirably includes at least one of inorganic substances such as h-BN, MgO, mullite ($3Al_2O_3.2SiO_2$), steatite ($MgO.SiO_2$), forsterite ($2MgO.SiO_2$), cordierite ($2MgO.2Al_2O_3.5SiO_2$), and zircon ($ZrO_2.SiO_2$).

When the melting point of the insulating material is 1200° C. or higher, the insulating material is excellent in terms of thermal and chemical stability, and thus, when a high-temperature treatment is performed, the dissolution of the insulating material and the reaction with the magnetic metal powder can be suppressed, which is advantageous for the improvement of the insulation properties and heat resistance of the dust core.

Here, as long as an insulating material has a compressive strength of 10000 kg/cm$^2$ or lower and a melting point of 1200° C. or higher, there is no problem in using the insulating material which does not belong to the insulating materials described in the table.

(Embodiment 2)

Hereinafter, the average particle diameter of the magnetic metal powder in the method of manufacturing a composite magnetic material, the dust core using the composite magnetic material, and the method of manufacturing the same in Embodiment 2 of the invention will be described.

Objects having similar configurations to Embodiment 1 will not be described again, and difference will be described in detail.

As the magnetic metal powder, Fe—Ni-based magnetic metal powder including 50% by weight of Ni as the composition (hereinafter referred to as 'Fe-50Ni') is used. Furthermore, Fe-50Ni magnetic metal powders having a variety of average diameters as shown in Table 6 are used. The magnetic metal powders are treated using a planetary ball mill so as to manufacture magnetic metal powders having a Vickers hardness of 350 Hv. As the insulating material, 6% by volume of mullite ($3Al_2O_3.2SiO_2$) having an average particle diameter of 2.5 μm and a compressive strength of 7100 kg/cm$^2$ is incorporated with respect to 100% by volume of the magnetic metal powder, and the insulating material is dispersed on the surface of the magnetic metal powder using a cross rotary, thereby manufacturing composite magnetic powder. 1.3 parts by mass of a butyral resin is mixed with respect to the composite magnetic powder as a binding agent so as to manufacture a compound. The obtained compound is pressed with a pressing pressure of 10.5 ton/cm$^2$ so as to manufacture a compact, and then a thermal treatment is performed at 880° C. in a $N_2$ atmosphere for 1 hour so as to manufacture a dust core.

The hardness of the magnetic metal powder, the compressive strength of the insulating material, and the shape, direct current superposition characteristics and magnetic loss of the obtained dust cores are evaluated in the same conditions as Embodiment 1. The obtained evaluation results are shown in Table 6.

TABLE 6

| | Magnetic metal powder | | Hardness- | Insulating | Compressive | | Average | | Magnetic | |
|---|---|---|---|---|---|---|---|---|---|---|
| Sample. No | Composition | Hardness (Hv) | improving process | material Composition | strength kg/cm$^2$ | Melting point ° C. | particle diameter (μm) | First permeability | loss (kW/m$^3$) | |
| 121 | Fe50Ni | 350 | Performed | MgO | 8400 | 2820 | 0.5 | 30 | 1150 | Comparative Example |
| 122 | | | | | | | 1 | 41 | 485 | Example |
| 123 | | | | | | | 5 | 50 | 412 | Example |
| 124 | | | | | | | 10 | 58 | 415 | Example |
| 125 | | | | | | | 50 | 82 | 670 | Example |

TABLE 6-continued

| Sample. No | Magnetic metal powder Composition | Hardness (Hv) | Hardness-improving process | Insulating material Composition | Compressive strength kg/cm$^2$ | Melting point ° C. | Average particle diameter (μm) | First permeability | Magnetic loss (kW/m$^3$) | |
|---|---|---|---|---|---|---|---|---|---|---|
| 126 | | | | | | | 100 | 90 | 980 | Example |
| 127 | | | | | | | 110 | 93 | 1520 | Comparative Example |

It is found from Samples No. 121 to 127 that, when the Fe-50Ni is used for the magnetic metal powder, excellent direct current superposition characteristics and a low magnetic loss are exhibited at an average particle diameter of 1 μm to 100 μm.

Since the average particle diameter is smaller than 1.0 μm, a high packing factor cannot be obtained, and therefore the direct current superposition characteristics are degraded, which is not preferable. In addition, when the average particle diameter is larger than 100 μm, the eddy-current loss becomes large in a high frequency range, which is not preferable. A more preferable range is 1 μm to 50 μm.

(Embodiment 3)

Hereinafter, the amount of the insulating material incorporated in the method of manufacturing a composite magnetic material, the dust core using the composite magnetic material, and the method of manufacturing the same in Embodiment 3 of the invention will be described. Objects having similar configurations to Embodiment 1 will not be described again, and differences will be described in detail.

As the magnetic metal powder, Fe—Si-based magnetic metal powder having an average diameter of 35 μm and an alloy composition of Fe-4Si by % by weight is used. The magnetic metal powder is treated using a tumbling ball mill so as to manufacture magnetic metal powder having a Vickers hardness of 350 Hv. As the insulating material, forsterite ($2MgO.SiO_2$) having an average particle diameter of 8 μm and a compressive strength of 5900 kg/cm$^2$ is weighed to be the % by volume shown in Table 7 and incorporated with respect to 100% by volume of the magnetic metal powder. After that, the insulating material is dispersed on the surface of the magnetic metal powder using a tumbling ball mill, thereby manufacturing composite magnetic powder. 1.2 parts by mass of a vinyl chloride resin is mixed with respect to the composite magnetic powder as a binding agent so as to manufacture a compound. The obtained compound is pressed with a pressing pressure of 12.5 ton/cm$^2$ so as to manufacture a compact, and then a thermal treatment is performed at 800° C. in a $N_2$ atmosphere for 60 minutes so as to manufacture a dust core.

The hardness of the magnetic metal powder, the compressive strength of the insulating material, and the shape, direct current superposition characteristics and magnetic loss of the obtained dust cores are evaluated in the same conditions as Embodiment 1. The obtained evaluation results are shown in Table 7.

TABLE 7

| Sample. No | Magnetic metal powder Composition | Hardness (Hv) | Hardness-improving process | Insulating material Composition | Compressive strength kg/cm$^2$ | Melting point ° C. | Mixed amount of insulating material | Packing factor (%) | Per-meability (550e) | Magnetic loss (kW/m$^3$) | |
|---|---|---|---|---|---|---|---|---|---|---|---|
| 128 | Fe—4Si | 350 | Performed | MgO | 8400 | 2820 | 0.5 | 86.2 | 105 | 9500 | Comparative Example |
| 129 | | | | | | | 1 | 83.1 | 61 | 490 | Example |
| 130 | | | | | | | 2.5 | 82.5 | 55 | 452 | Example |
| 131 | | | | | | | 5 | 81.6 | 51 | 468 | Example |
| 132 | | | | | | | 10 | 80.1 | 40 | 485 | Example |
| 133 | | | | | | | 13 | 79.5 | 35 | 557 | Comparative Example |

It is found from Samples No. 128 to 133 that, when the incorporated amount of the insulating material is 1% to 10% by volume, it is possible to realize a method of manufacturing a composite magnetic material for a dust core exhibiting favorable direct current superposition characteristics and a low magnetic loss.

When the incorporated amount of the insulating material is smaller than 1.0% by volume, the insulation properties are degraded in the magnetic metal powder in the composite magnetic material, and thus the eddy-current loss becomes large, which is not preferable. In addition, when the incorporated amount of the insulating material is larger than 10% by volume, the packing factor of the Fe—Si-based magnetic metal powder in the dust core is degraded, and thus the direct current superposition characteristics are degraded, which is not preferable.

(Embodiment 4)

Hereinafter, the melting point and annealing temperature of the insulating material in the method of manufacturing a composite magnetic material, the dust core using the composite magnetic material, and the method of manufacturing the same in Embodiment 4 of the invention will be described.

Objects having similar configurations to Embodiment 1 will not be described again, and differences will be described in detail.

As the magnetic metal powder, Fe—Ni-based magnetic metal powder having an average diameter of 15 μm and an alloy composition of Fe-78Ni by % by weight is used. The magnetic metal powder is treated using a tumbling ball mill so as to improve the hardness of the magnetic metal powder, thereby manufacturing magnetic metal powder having a Vickers hardness of 350 Hv. As the insulating material, 4% by volume of MgO having an average particle diameter of 1 μm and a compressive strength of 8400 kg/cm$^2$ is weighed and incorporated with respect to 100% by volume of the magnetic metal powder. The insulating material is dispersed on the surface of the magnetic metal powder using a planetary ball mill, thereby manufacturing composite magnetic powder. One part by mass of an acryl resin is mixed with respect to the composite magnetic powder as a binding agent so as to manufacture a compound. The obtained compound is pressed with a pressing pressure of 12 ton/cm$^2$ so as to manufacture a compact, and then a thermal treatment is performed at each of the thermal treatment temperatures shown in Table 8 in an Ar atmosphere for 1 hour so as to manufacture a dust core.

The hardness of the magnetic metal powder, the compressive strength of the insulating material, and the shape, direct current superposition characteristics and magnetic loss of the obtained dust cores are evaluated in the same conditions as Embodiment 1. The obtained evaluation results are shown in Table 8.

In addition, the insulating material in the dust core of the invention includes at least one of inorganic substances of h-BN, MgO, mullite ($3Al_2O_3.2SiO_2$), steatite ($MgO.SiO_2$) forsterite ($2MgO.SiO_2$), cordierite ($2MgO.2Al_2O_3.5SiO_2$), and zircon ($ZrO_2.SiO_2$).

In addition, the insulating material in the dust core of the invention has a melting point of 1200° C. or higher.

In addition, the packing factor of the magnetic metal powder for the dust core of the invention is 80% or higher when computed by volume.

With the above configuration, it is possible to provide a dust core exhibiting a favorable permeability and a low magnetic loss.

In addition, the method of manufacturing a dust core of the invention includes a step in which a composite magnetic material including a magnetic metal material having a Vickers hardness (Hv) of 230≦Hv≦1000 and an insulating material having a compressive strength of 10000 kg/cm$^2$ or lower is pressed so as to form a compact, and a step in which a thermal treatment is performed on the compact, and, in the step of forming the compact, the insulating material is made to be in a mechanical collapsed state.

TABLE 8

| Sample. No | Magnetic metal powder Composition | Hardness (Hv) | Hardness-improving process | Insulating material Composition | Compressive strength kg/cm$^2$ | Melting point ° C. | Annealing temperature (° C.) | Packing factor (%) | Permeability (550e) | Magnetic loss (kW/m$^3$) | |
|---|---|---|---|---|---|---|---|---|---|---|---|
| 134 | Fe78Ni | 350 | Performed | MgO | 8400 | 2820 | 600 | 81.3 | 50 | 610 | Comparative Example |
| 135 | | | | | | | 700 | 81.4 | 51 | 468 | Example |
| 136 | | | | | | | 800 | 81.6 | 51 | 415 | Example |
| 137 | | | | | | | 900 | 81.9 | 52 | 345 | Example |
| 138 | | | | | | | 1000 | 82 | 52 | 325 | Example |
| 139 | | | | | | | 1150 | 82.2 | 53 | 358 | Example |
| 140 | | | | | | | 1200 | 82.6 | 59 | 15900 | Comparative Example |

It is found from Samples No. 134 to 140 that, by performing a thermal treatment in a temperature range of 700° C. to 1150° C. after the pressing, it is possible to realize a method of manufacturing a composite magnetic material for a dust core exhibiting favorable direct current superposition characteristics and a low magnetic loss.

When the thermal treatment temperature is lower than 700° C., strain is not sufficiently relieved during the pressing, and a magnetic loss also cannot be sufficiently reduced, which is not preferable. In addition, when thermal treatment temperature is higher than 1150° C., the magnetic metal powder particles sinter to each other, and the eddy-current loss becomes large, which is not preferable.

From the above, the dust core of the invention is a dust core including magnetic metal powder and an insulating material, in which the magnetic metal powder has a Vickers hardness (Hv) of 230≦Hv≦1000, the insulating material has a compressive strength of 10000 kg/cm$^2$ or lower and is in a mechanical collapsed state, and the insulating material in a mechanical collapsed state is interposed in the magnetic metal powder.

In addition, the magnetic metal powder for the dust core of the invention includes at least one of Fe—Ni-based, Fe—Si—Al-based, Fe—Si-based, Fe—Si—Cr-based, and Fe-based magnetic metal powder.

In addition, the average particle diameter of the magnetic metal powder for the dust core of the invention is 1 μm to 100 μm.

In addition, in the method of manufacturing a dust core of the invention, in the step of performing the thermal treatment on the compact, the compact is annealed in a non-oxidizing atmosphere at a temperature of 700° C. to 1150° C.

In addition, the method of manufacturing a composite magnetic material of the invention includes a step in which the hardness of magnetic metal powder is increased so that the magnetic metal powder has a Vickers hardness (Hv) of 230≦Hv≦1000, and a step in which an insulating material having a compressive strength of 10000 kg/cm$^2$ or lower is dispersed in the magnetic metal powder.

In addition, in the method of manufacturing a composite magnetic material of the invention, the incorporated amount of the insulating material is 1% to 10% by volume when the volume of the magnetic metal powder is set to 100% by volume.

With the above configuration, it is possible to provide a dust core exhibiting a favorable permeability and a low magnetic loss, a method of manufacturing the dust core, and a method of manufacturing a composite magnetic material for the above method.

Industrial Applicability

Since it is possible to provide a dust core having excellent magnetic properties using the composite magnetic material, the method of manufacturing the composite magnetic material, a dust core using the composite magnetic material, and a method of manufacturing the same according to the invention, the invention is useful to decrease the size, increase the electric current, and increase the frequency of a magnetic element, such as a choke coil using the invention.

The invention claimed is:

1. A dust core, comprising:

a magnetic metal powder; and an insulating material, wherein the magnetic metal powder has a Vickers hardness (Hv) of $230 \leqq Hv \leqq 1000$;

the insulating material has a compressive strength of 10000 $kg/cm^2$ or lower and is in a mechanical collapsed state; and the insulating material in a mechanical collapsed state is interposed in the magnetic metal powder.

2. The dust core of claim 1, wherein the magnetic metal powder includes at least one of Fe—Ni-based, Fe—Si—Al-based, Fe—Si-based, Fe—Si—Cr-based, and Fe-based magnetic metal powders.

3. The dust core according to claim 1, wherein an average particle diameter of the magnetic metal powder is 1 μm to 100 μm.

4. The dust core according to claim 1, wherein the insulating material includes at least one of inorganic substances of h-BN, MgO, mullite ($3Al_2O_3.2SiO_2$), steatite ($MgO.SiO_2$), forsterite ($2MgO.SiO_2$), cordierite ($2MgO.2Al_2O_3.5SiO_2$), and zircon ($ZrO_2.SiO_2$).

5. The dust core according to claim 1, wherein the insulating material has a melting point of 1200° C. or higher.

6. The dust core according to claim 1, wherein a packing factor of the magnetic metal powder is 80% or higher when computed by volume.

7. A method of manufacturing a dust core, comprising:

a step in which an insulating material having a compressive strength of 10000 $kg/cm^2$ or lower is dispersed in a magnetic metal material having a Vickers hardness (Hv) of $230 \leqq Hv \leqq 1000$, a step in which a composite magnetic material obtained in the dispersing step is pressed so as to form a compact; and a step in which a thermal treatment is performed on the compact, wherein, in the step of forming the compact, the insulating material is made to be in a mechanical collapsed state.

8. The method of manufacturing a dust core according to claim 7, wherein, in the step of performing the thermal treatment on the compact, the compact is annealed in a non-oxidizing atmosphere at a temperature of 700° C. to 1150° C.

9. The method of manufacturing a dust core according to claim 7, wherein the magnetic metal powder includes at least one of Fe—Ni-based, Fe—Si—Al-based, Fe—Si-based, Fe—Si—Cr-based, and Fe-based magnetic metal powder.

10. The method of manufacturing a dust core according to claim 7, wherein the average particle diameter of the magnetic metal powder is 1 μm to 100 μm.

11. The method of manufacturing a dust core according to claim 7, wherein the insulating material includes at least one of inorganic substances of h-BN, MgO, mullite ($3Al_2O_3.2SiO_2$), steatite ($MgO.SiO_2$), forsterite ($2MgO.SiO_2$), cordierite ($2MgO.2Al_2O_3.5SiO_2$), and zircon ($ZrO_2.SiO_2$).

12. The method of manufacturing a dust core according to claim 7, wherein the insulating material has a melting point of 1200° C. or higher.

13. The method of manufacturing a dust core according to claim 7, wherein the packing factor of the magnetic metal powder is 80% or higher when computed by volume.

14. The method of manufacturing a dust core, according to claim 7, wherein an incorporated amount of the insulating material is 1% to 10% by volume when the volume of the magnetic metal powder is set to 100% by volume.

* * * * *